US005105998A

United States Patent [19]

Ilott

[11] Patent Number: 5,105,998

[45] Date of Patent: Apr. 21, 1992

[54] PAINT RESERVOIR FOR SPRAYING APPARATUS

[76] Inventor: Jan Ilott, 134, Overland Road, Mumbles, Swansea, SA1 1AA, Great Britain

[21] Appl. No.: 585,059

[22] PCT Filed: Apr. 19, 1989

[86] PCT No.: PCT/GB89/00409

§ 371 Date: Dec. 18, 1990

§ 102(e) Date: Dec. 18, 1990

[87] PCT Pub. No.: WO89/10270

PCT Pub. Date: Nov. 2, 1989

[30] Foreign Application Priority Data

Apr. 19, 1988 [GB] United Kingdom ..... 8809224

[51] Int. Cl.[5] ..... B65D 47/00

[52] U.S. Cl. ..... 222/547; 137/209; 220/502; 222/209; 222/464; 222/548; 401/188 R; 401/190

[58] Field of Search ..... 222/209, 398, 399, 401, 222/464, 547, 548, 564; 220/501, 502; 401/187, 188 R, 190; 137/209; 138/46

[56] References Cited

U.S. PATENT DOCUMENTS 1,493,133 5/1924 Sykora ..... 251/209 X
2,550,404 4/1951 Chasan et al. ..... 239/346
4,331,255 5/1982 Fournier ..... 222/547 X
4,420,098 12/1983 Bennett ..... 222/401 X

*Primary Examiner*—Kevin P. Shaver
*Assistant Examiner*—Joseph A. Kaufman
*Attorney, Agent, or Firm*—Fleit, Jacobson, Cohn, Price, Holman & Stern

[57] ABSTRACT

A first cup member (4) has (a) a first channel (18) which passes radially from the center of its bottom panel (6) along the inside surface of said bottom panel (6) and substantially axially, upwardly along the inside of its wall(s) (8) and (b) an outlet (16) which communicates with the first channel (18) at a point remote from said bottom panel (6). A second cup member (10) has an opening (20) in its bottom panel (12) at an edge of the bottom panel (12) which communicates with a second channel (22) which passes radially along the outside surface of its bottom panel (12). The second cup member (10) is positionable within the first cup member (4) for moving the opening (20) to the lowest point in the second cup member (10). The first and second channels (18, 22) are always in communication with one another regardless of relative alignment of the first and second cup members (4, 10), such that a fluid held within the second cup member (10) can flow through the opening (20), second channel (22), first channel (18) and outlet (16). The two cup members (4, 10) are easily separated providing access to the channels (18, 22) to facilitate cleaning.

5 Claims, 3 Drawing Sheets

PAINT RESERVOIR FOR SPRAYING APPARATUS

FIELD OF THE INVENTION

The present invention relates to reservoirs for fluids and more particularly, but not exclusively, to reservoirs for feeding paint to airbrushes used in artwork.

BACKGROUND OF THE INVENTION

An airbrush normally has mounted thereon a reservoir in which is held a quantity of paint to be fed to the airbrush. By the very nature of the paint, there is a tendency for the passage or passages in the reservoir through which the paint passes to become blocked with dried paint. In order that the cup can be used further, it is necessary for it to be cleaned out. As the dimensions of such cups and the passages therein are normally very small, such a cleaning process is time-consuming and not necessarily very efficient.

Furthermore, as the orientation of the airbrush, and hence of a reservoir which is attached thereto, varies from user to user or even whilst being used by one user, an outlet for paint in the reservoir may not always be at the lowest point. In the case where for example the paint is fed to the airbrush by suction, this could have the effect that air enters the suction line.

SUMMARY OF THE INVENTION

In accordance with the present invention there is provided a reservoir comprising:

a first cup member including a first bottom panel, a first wall or walls extending from the first bottom panel, an outlet and a first channel which extends radially from the centre of the first bottom panel along the inside surface of the first bottom panel and axially or substantially axially along the inside of the first wall or walls and communicates with the outlet at a point remote from the first bottom panel; and a second cup member including a second bottom panel, a second wall or walls extending from the second bottom panel and an opening formed in the second bottom panel and which communicates with a second channel which extends radially to the centre of the second bottom panel along the outside surface of the second bottom panel, the second cup member being positionable within the first cup member;

characterized in that the first and second channels are always in communication with one another regardless of relative alignment of the first and second cup members so that a fluid held within the second cup member can flow through the opening and through the first and second channels to the outlet.

BRIEF DESCRIPTION OF THE DRAWINGS

The present invention will not be described by way of example with reference to the accompanying drawings, in which.

DETAILED DESCRIPTION OF THE INVENTION

The following description is directed to a reservoir for feeding paint to an airbrush. It is, however, emphasised that it can equally be used in any other application where it is desired to feed a suitable fluid.

Figure 1:
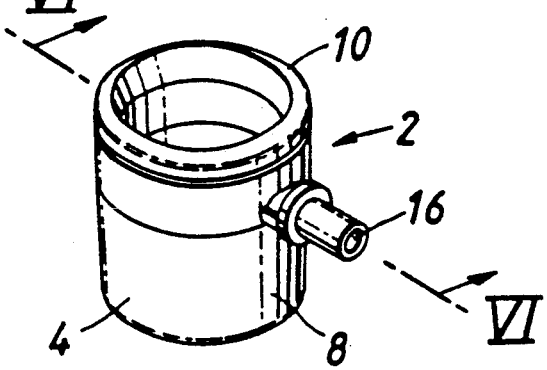
FIG. 1 is a perspective view of an assembled reservoir.
Figure 2:
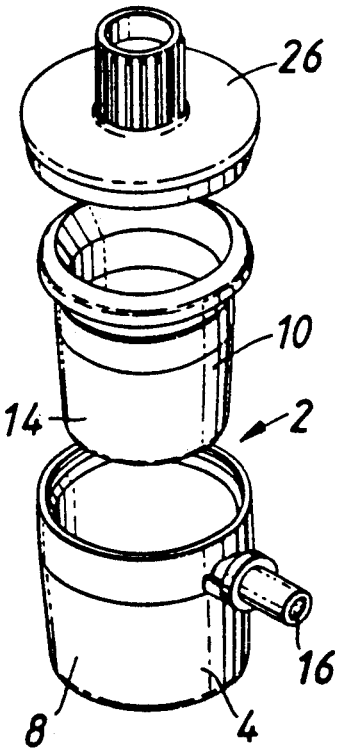
FIG. 2 is an exploded view of the reservoir of FIG. 1, also showing a suitable cap.

As shown in FIGS. 1 and 2, reservoir 2 comprises an outer cup 4 having a bottom panel 6 (See FIGS. 3 and 4) and a substantially cylindrical wall 8 extending from the bottom panel 6. Within the outer cup 4 is positioned an inner cup 10. The inner cup 10 has a bottom panel 12 and substantially cylindrical wall 14 extending from the bottom panel 12. The outer cup 4 is provided with an outlet tube 16.

Figure 3:
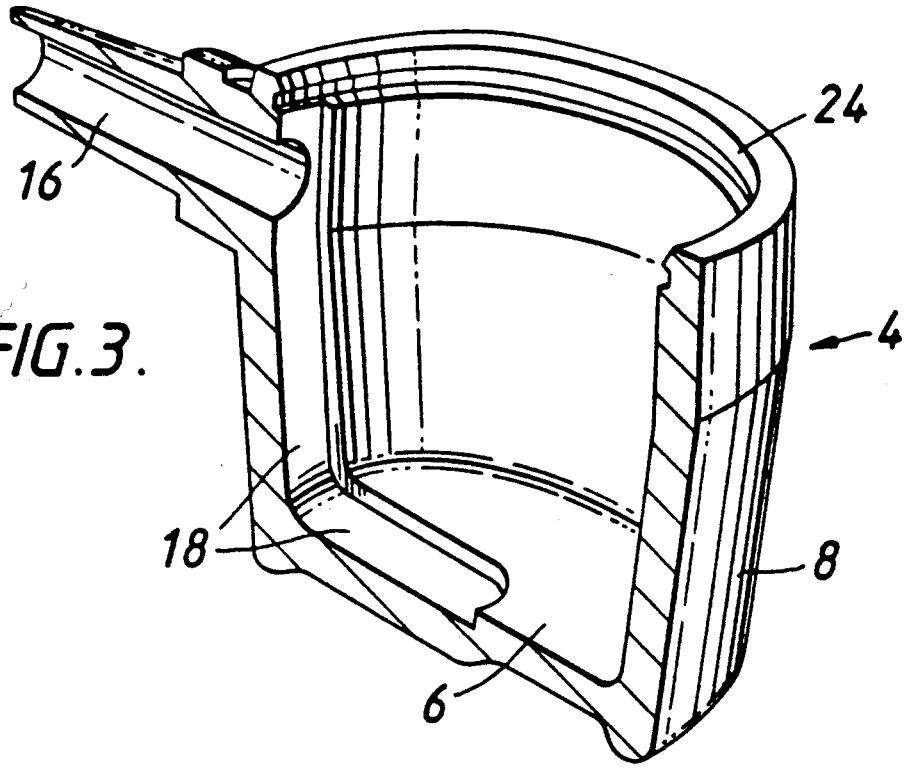
FIG. 3 is a fragmentary view showing the interior of the outer cup of the reservoir.
Figure 4:
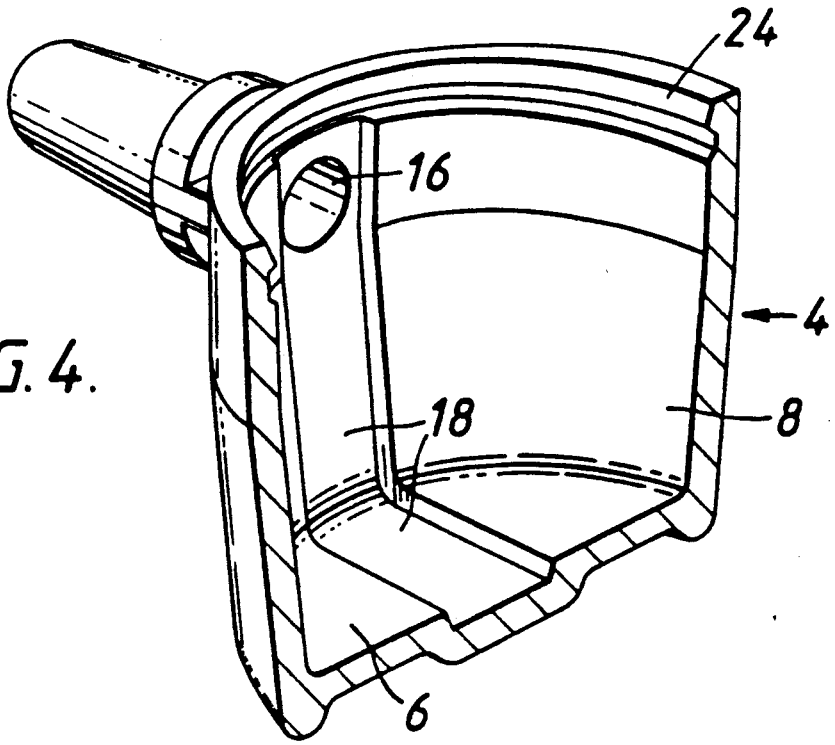
FIG. 4 is a further fragmentary view showing the interior of the outer cup of the reservoir.

Referring to FIGS. 3 and 4, there is shown a channel 18 which extends radially from the centre of the bottom panel 6 along the inner surface of the bottom panel 6 to the wall 8 and then substantially axially along the inner surface of the wall 8. The outlet tube 16 communicates with the channel 18 at a point remote from the bottom panel 6.

Figure 5:
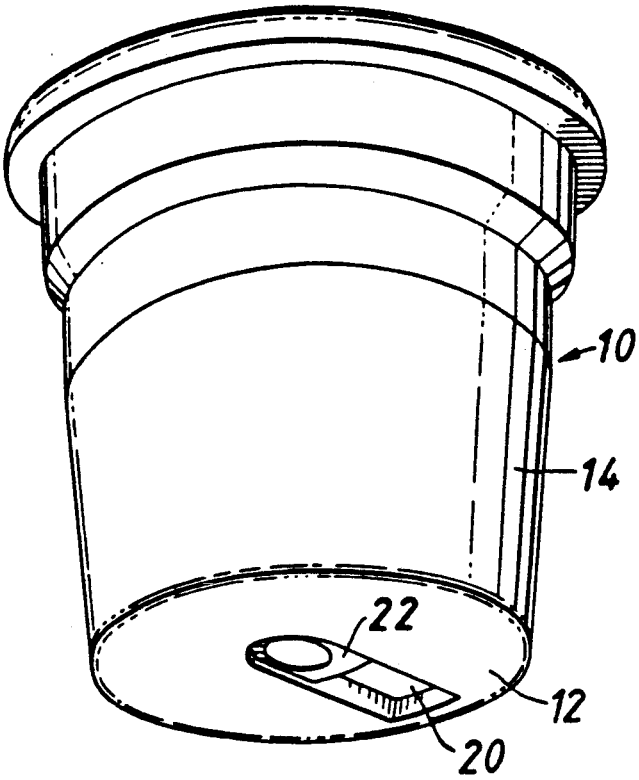
FIG. 5 is a view of the outer surface of the inner cup of the reservoir.

Referring to FIG. 5, there is shown an opening 20 in bottom panel 12. A channel 22, which communicates with the opening 20, extends radially from the opening 20 along the outer surface of the bottom panel 12 to the centre of the bottom panel 12.

Figure 6:
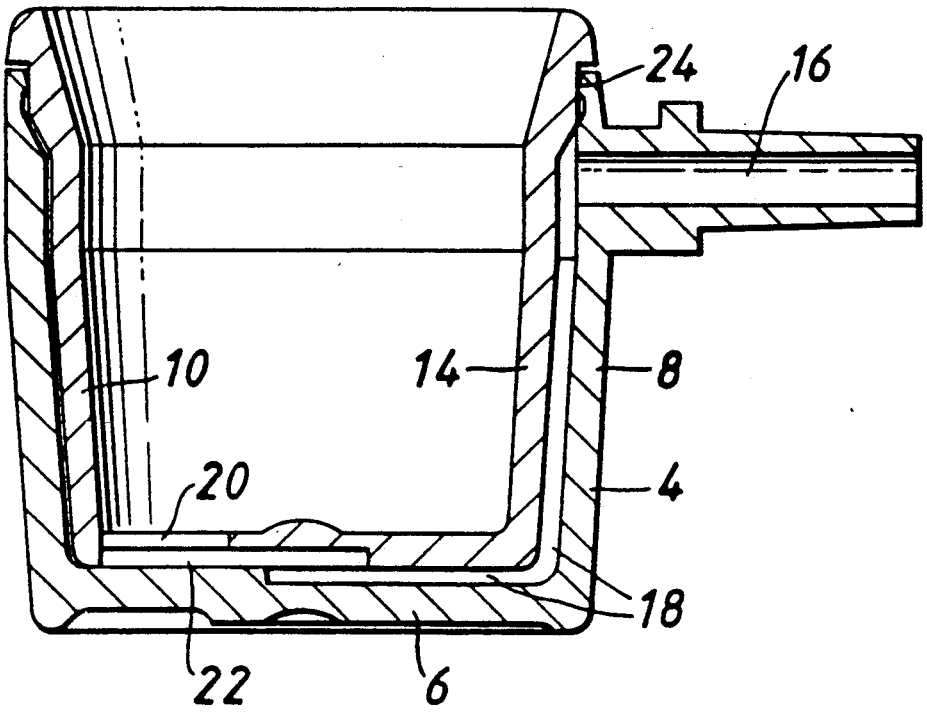
FIG. 6 is a section along the line VI—VI of FIG. 1 showing the inner and outer cups in a first relative orientation.
Figure 7:
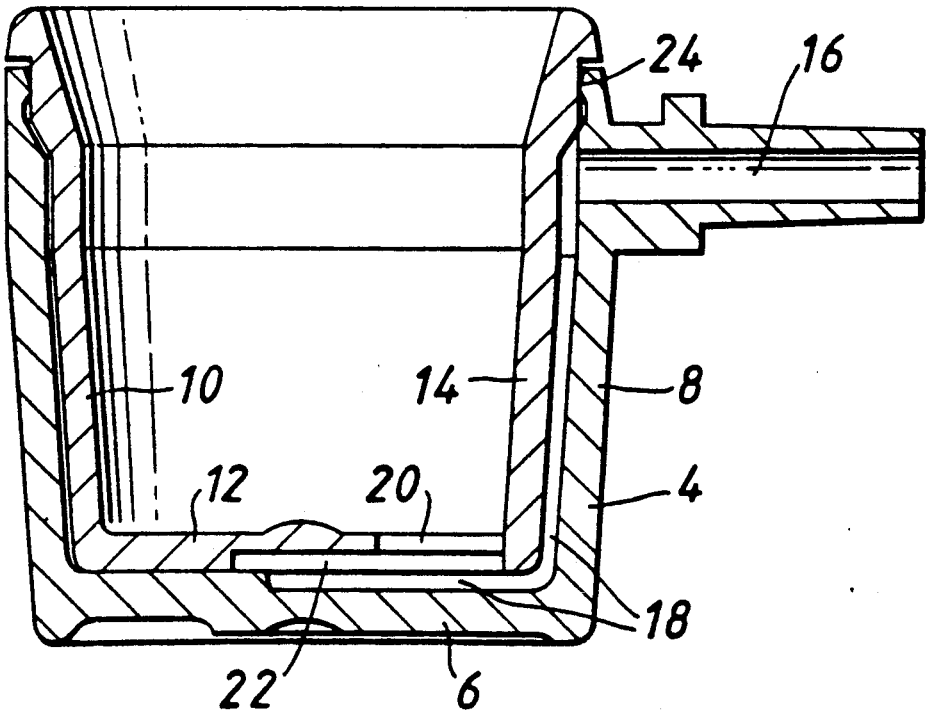
FIG. 7 is a section along the line VI—VI of FIG. 1 showing the inner and outer cups in a second relative orientation.

As shown in FIGS. 6 and 7, when the inner cup 10 is positioned within the outer cup 4 the respective ends of the channels 18 and 22 at the respective centres of the bottom panels 6 and 12 communicate with each other.

FIG. 6 shows the situation when the cups 4 and 10 are so arranged that the opening 20 is on the opposite side of the reservoir 2 to the outlet tube 16, whereas FIG. 7 shows the situation when the cups 4 and 10 are so arranged that the opening 20 is on the same side of the reservoir 2 as the outlet tube 16. The cups 4 and 10 can in fact be arranged in any rotational relationship to each other between the positions shown in FIGS. 6 and 7. As can be seen, the opening 20 is always in communication with the channel 18, with some orientations directly and with other orientations through channel 22, so that fluid held within the inner cup 10 can always flow through the opening 20 to the channel 18 and thence through the outlet tube 16.

The advantage of the cups 4 and 10 being relatively rotatable is that, regardless of the orientation of the reservoir 2, the point in the bottom of the inner cup 10 at which fluid flows out of the inner cup 10 can be adjusted to be at the lowest point. This is of particular value in the case of an airbrush, where the orientation may be different for different users or may vary while being used by one user depending on requirements.

In the case of use with an airbrush, it is normal practice to transfer paint from the reservoir 2 to the airbrush by applying suction to the outlet tube 16. In such a case, it is necessary to ensure that there is a gas-tight seal between the cups 4 and 10 at least around rim 24 of the outer cup 4.

Being able to adjust the point at which paint leaves the inner cup 20 so that it is always at the lowest point, and hence covered by paint which gravitates to that point, enables the user to reduce the risk of air being sucked into the outlet tube 16.

If desired, the reservoir 2 can be provided with a cap, an example of which is denoted by numeral 26 in FIG. 2.

As an alternative to applying suction to the outlet tube 16, the paint may alternatively be urged out of the reservoir 2 by any other suitable means such as, for example, a pressure line (not shown) attached to the top of the inner cup 10, for example to a cap such as cap 26 (See FIG. 2) provided with a suitable aperture. Alternatively, there can be provided a flexible cap on the inner cup 10 which can be pressed inwardly, by for example a finger, to increase the pressure in the inner cup 10.

The ability to easily separate the two cups and the fact that when the cups are separated the channels are then readily accessible enables the reservoir of the present invention to be easily cleaned.

Although the present invention has been described above by reference to inner and outer cups each having a substantially cylindrical wall, it is emphasised that the cups can in fact have any suitable number of walls, either curved or flat.

I claim:

1. A reservoir comprising:

a first cup member (4) including a first bottom panel (6), a first wall (8) extending from the first bottom panel (6), an outlet (16) and a first channel (18) which extends radially from the centre of the first bottom panel (6) along the inside surface of the first bottom panel (6) and axially or substantially axially along the inside of the first wall (8) and communicates with the outlet (16) at a point remote from the first bottom panel (6); and a second cup member (10) including a second bottom panel (12), a second wall (14) extending from the second bottom panel (12) and an opening (20) formed in the second bottom panel (12) and which communicates with a second channel (22) which extends radially to the centre of the second bottom panel (12) along the outside surface of the second bottom panel (12), the second cup member (10) being positionable within the first cup member (4);

wherein the first and second channels (18, 22) are always in communication with one another regardless of relative alignment of the first and second cup members (4, 10) so that a fluid held within the second cup member (10) can flow through the opening (20) and through the first and second channels (18, 22) to the outlet (16).

2. A reservoir according to claim 1 wherein said first wall of said first cup member has an upper rim and wherein a gas-tight seal is provided between the first and second cup members (4, 10) at least around said upper rim (24) of the first cup member (4).

3. A reservoir according to claim 1, wherein the first and second walls (8, 14) are cylindrical or substantially cylindrical.

4. A reservoir according to claim 2 further including a cap for said second cup.

5. A reservoir according to claim 4 wherein said cap is apertured whereby said second cup may be connected to a source of pressure.

* * * * *